US005229541A

United States Patent [19]

Will et al.

[11] Patent Number: 5,229,541

[45] Date of Patent: Jul. 20, 1993

[54] TORPEDO SAFETY SYSTEM

[75] Inventors: Albert S. Will, Bethesda; Armand Cioccio, Silver Spring, both of Md.

[73] Assignee: The United States of America as represented by the Secretary of the Navy, Washington, D.C.

[21] Appl. No.: 640,315

[22] Filed: Dec. 8, 1975

[51] Int. Cl.[5] ..... F42B 3/18; F42B 19/01; B63G 9/00

[52] U.S. Cl. ..... 102/202.1; 114/21.2; 114/21.3; 114/240 R; 340/852; 367/99; 367/118

[58] Field of Search ..... 102/70.2 P, 202.1; 114/21 A, 23, 240 R, 240 D, 21.3, 21.2; 340/3 E, 852; 343/7 ED, 7 PF, 15, 18 E; 367/99, 118

[56] References Cited

U.S. PATENT DOCUMENTS

| | | | |
|---|---|---|---|
| 2,832,041 | 4/1958 | Trachtenberg | 114/240 R |
| 3,073,550 | 1/1963 | Young | 343/7 ED |
| 3,110,877 | 11/1963 | Fisher et al. | 340/5 R |
| 3,616,754 | 11/1971 | Frenkel | 102/70.2 P |
| 3,706,096 | 12/1972 | Hammack | 343/15 |

*Primary Examiner*—Stephen C. Buczinski
*Attorney, Agent, or Firm*—John D. Lewis; Jacob Shuster

[57] ABSTRACT

A safety system for deterring a homing missile from attacking its launching vehicle whereby the launching vessel is enabled to alter the course and neutralize the detonator of the weapon.

8 Claims, 2 Drawing Sheets

CONFIDENTIAL

TORPEDO SAFETY SYSTEM

BACKGROUND OF THE INVENTION

The present invention relates to homing missiles, and more particularly, to a turnaway and dudding deterrent to an accidental attack by a weapon on its launching vessel.

In homing weapons, a search and acquisition system examines the surrounding environment, usually by acoustic or electronic means, for noise emanating from or, for other signs indicative of, the presence of a target. When first launched, the immediate proximity of the launching vehicle and the amplitude of its attendant noise shadow the presence of the target and increase the risk that the weapon's search system will acquire and return to the launching vehicle. Consequently, the weapon's search and acquisition system can not be activated until the weapon has traveled a predetermined distance (i.e., cleared the activation zone) from the launching vehicle.

Variable propagation conditions, quieting trends in vessel construction as well as mere quiescence, however, frequently mask the presence of a target until it is at close quarters with the launching vessel, often inside or just outside the activation zone. In these situations, as the azimuth, depth and range of the target is seldom immediately ascertainable, a vessel-to-vessel weapon must be capable of, on sudden launching, searching for and acquiring a vagariously moveable target at close quarters without endangering the launching vessel. Prior art weapon safety systems protect the launching vessel from an undesired attack by its own weapon by controlling activation and operation of the weapon's search and acquisition system. The weapon's system is not activated until the weapon has cleared a volume surrounding the launching vessel that can be best described as a spheroid having a semiaxis approximately colinear with the major axis of the launching vessel (i.e., a protective zone). If the weapon re-enters the spheroid, its system is deactivated. When the weapon is outside of the spheroid, its system is limited in its search to a lunular segment of a sphere. When launched against a target at close quarters with the launching vessel, a weapon having a prior art safety system has little or no opportunity for search and acquisition of the target.

SUMMARY OF THE INVENTION

The present invention overcomes the disadvantages, inconveniences and limitations of the prior art by providing a novel safety system for deterring a weapon from acquiring, homing on and attacking its launching vehicle whereby the weapon's guidance system is given greater opportunity for search and acquisition at close quarters when launched against a target having an unknown position and a capability for vagarious movement. Embodiments of the present invention use a tracking circuit for locating and following a weapon, a turnaway circuit for altering the course of a weapon that is homing on its launching vessel, and a dudding circuit for neutralizing the detonator of a weapon that has returned to within a preselected distance of the launching vessel, to provide adequate opportunity for search and acquisition of the target. A weapon so equipped may begin its search for a vagariously moveable target while in close linear proximity with its launching vehicle.

An object of the present invention is to provide a means for deterring a returning weapon from attacking its launching vehicle.

Another object of the present invention is to provide a safety system for deterring a returning weapon from attacking its launching vehicle whereby a weapon launched at close quarters against a vagariously moveable target will have adequate opportunity to search for and acquire the target.

Yet another object of the present invention is to provide a safety system whereby the course of a returning weapon may be altered without interrupting the operation of the weapon's search and acquisition system.

Still another object of the present invention is to provide a safety system whereby the detonator of a returning warhead may be neutralized without interrupting the operation of the weapon's search and acquisition system.

Still yet another object of the present invention is to provide a safety system for deterring a weapon from attacking its launching vessel, that is adaptable to prior art search and acquisition sytems.

BRIEF DESCRIPTION OF THE DRAWINGS

A more complete appreciation of this invention and many of the attendant advantages thereof will be readily appreciated as the same becomes better understood by reference to the following detailed description when considered in connection with the accompanying drawings wherein.

DETAILED DESCRIPTION OF THE PREFERRED EMBODIMENT

Figure 1:
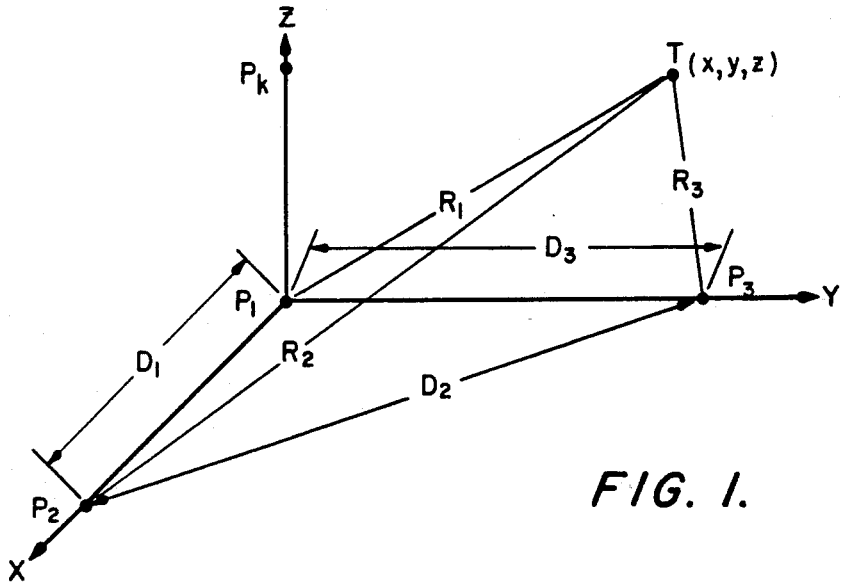
FIG. 1 is a geometric diagram of the relative positions of the transducers used in the circuits of embodiments of the invention.

Referring now to the drawings wherein like reference characters designate identical or corresponding parts throughout the several views, and more particularly, to FIG. 1 wherein a set of three Cartesian coordinates is superimposed on a point source spatial representation of the transponder of a weapon, point T, and the hydrophones of its launching vessel, points $P_1$, $P_2$, $P_3$ $P_k$. At least three antennae, such as hydrophones, are mounted in a non-colinear array on the launching vessel. After the weapon has been launched, one of the hydrophones mounted on the launching vessel issues an acoustic pulse. The weapon transponder receives the pulse and within a short time transmits a return pulse. Using classical rangefinding techniques, the distance $R_x$ between any hydrophone and the weapon transponder located at point T is proportional to the time "t" lapsing between transmission of the pulse and receipt of the return pulse according to the formula:

$$R_x = \frac{c \cdot t}{2} \tag{1}$$

The variable "c" is the speed of sound in the surrounding medium. Accordingly, the distances between hydrophones located at $P_1$, $P_2$ and $P_3$ and the transponder located at point T, respectively, $R_1$, $R_2$ and $R_3$, are readily ascertainable. Then, three of the hydrophones that have received the return pulse, perhaps those located at points $P_1$, $P_2$ and $P_3$, are taken as defining an X-Y plane. The distances between points $P_1$ and $P_2$, $P_2$ and $P_3$, and $P_1$ and $P_3$ are the known values $D_1$, $D_2$ and $D_3$, respectively. By simultaneously solving the equations of three spheres with centers at $P_1$, $P_2$ and $P_3$, respectively:

$$x^2+y^2+z^2=R_1^2 \quad (2)$$

$$(D_1-x)^2+y^2+z^2=R_2^2 \quad (3)$$

$$x^2+(D_3-y)^2+z^2=R_3^2 \quad (4)$$

the x, y and z coordinates, and thus the location of point T, may be determined.

After each pulse is received, and the interval of time between transmission and reception for each hydrophone is noted, another pulse is transmitted and the process is repeated, thereby enabling the launching vessel to continuously track the weapon's progress.

Figure 2:
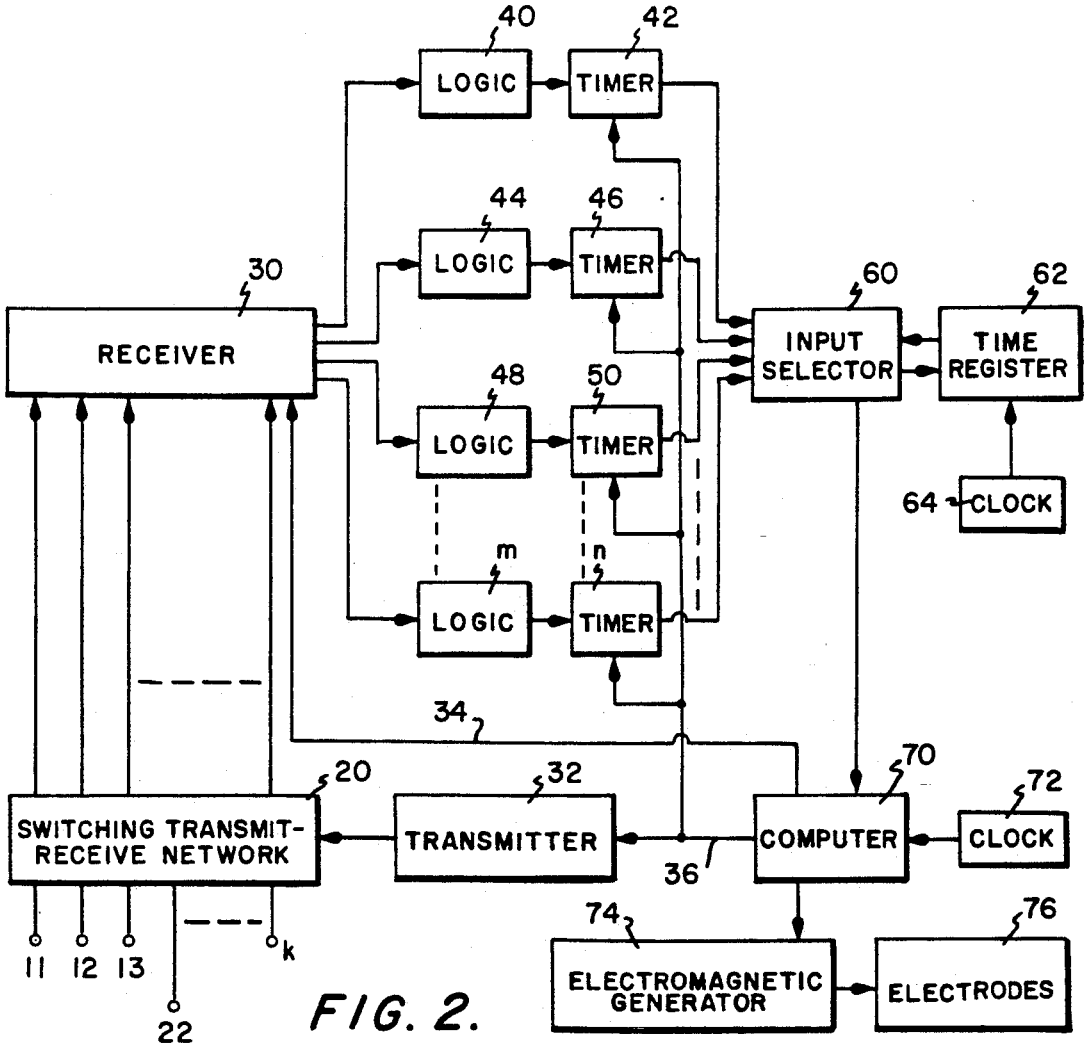
FIG. 2 is a block diagram of a weapon safety system according to the invention.

FIG. 2 sets forth in a block diagram the interconnections between the various components of the weapon tracking circuit, the weapon turn-away circuit, and the weapon dudding circuit. Hydrophones 11, 12, 13 . . . k are mounted on the launching vessel in a non-colinear array and connected in separate channels through the switching transmit-receive network 20 and the receivers 30.

A preselected interval after launching of a weapon, computer 70 notes the time shown by clock 72 and sends a start signal over line 36 to transmitter 32 and timers 42, 46, 50. Upon receipt of the start signal timers 42, 46, 50 assume an ON state. Simultaneously, transmitter 32 generates an acoustic signal via switching transmit-receive network 20 and transducer 22. Switching transmit-receive network controls the connection of hydrophones 11, 12, 13 to receiver 30 so as to prevent reception during transmission. After receiving the acoustic signal, the weapon transponder (not shown) transmits a return acoustic signal. The return signal is received by hydrophone 11, connected via switching network 20 to and detected by one channel of receiver 30. Logic devices 40, 44, 48 are individually connected in series between timers 42,46, 50 respectively, and a corresponding channel of receiver 30. Upon detection of a return signal, receiver 30 generates a signal that switches logic device 40 to its ON state, thereby causing timer 42 to cease generation of periodic pulses. Timers 42, 46, 50 . . . n mark the transient time of the acoustic signal as it travels between transducer 22 and the corresponding hydrophone 11, 12, 13, . . . k. Input selector 60 senses the cessation of periodic pulses by timer circuit 42, transmits a pulse to time register 62, and conveys data to computer 70 indicative of the time at which timer 42 ceased generating. Time register 62 and computer 70 reference the pulse with the time shown by clocks 64 and 72, respectively. Ultimately, the return acoustic signal is individually received by hydrophones 12, 13, detected by the corresponding channels of receiver 30, thereby switching the corresponding logic devices, 44, 48 to their ONE states.

As each of the timers 46, 50 ceases generation of periodic pulses in response to the corresponding logic device being switched to its ON state, input selector 60 transmits a pulse to time-register 62 and computer 70, both of which reference their reception of the pulse with the time shown by clocks 64 and 72 respectively.

Upon receipt of the third set of data provided by input selector 60, computer 70 first calculates the corresponding distances $R_x$ according to formula (1), and then calculates the coordinates of the weapon transponder according to formulae (2), (3) and (4)

After receiving the data transmitted by input selector 60, computer 70 generates a clear signal over line 34 in order to ground the channels of receiver 30 and to switch logic devices 40, 44,48 to their ZERO logic state. Computer 70 then notes the time shown by clock 72 and sends start signal over line 36, thereby reinitiating the tracking process.

By comparison with previously calculated coordinates, computer 70 is able to track the course of the weapon transponder. If computer 70 determines that the weapon transponder has reentered the protective zone on a course homing on the launching vessel, it causes transmitter 32 to generate a coded acoustic signal via transducer 22. Upon receipt of the coded acoustic signal by the weapon transponder, the weapon, alters its course and resumes search for a target in a sector other than that in which it acquired the launching vessel.

Figure 4:
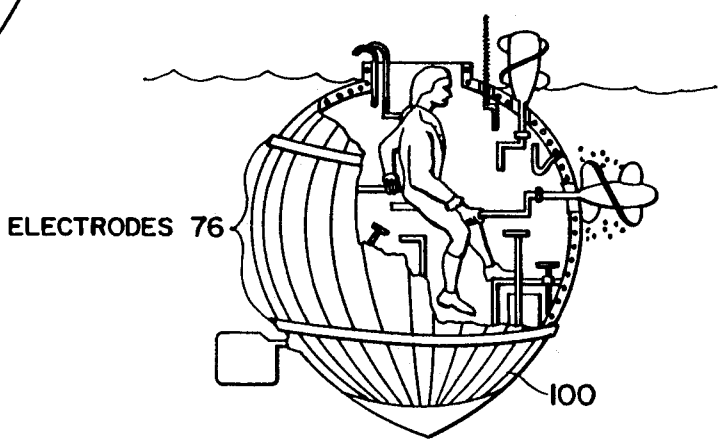
FIG. 4 is a partially cut-away drawing illustrating the installation of a pair of electrodes on the hull of a submarine.
Figure 3:
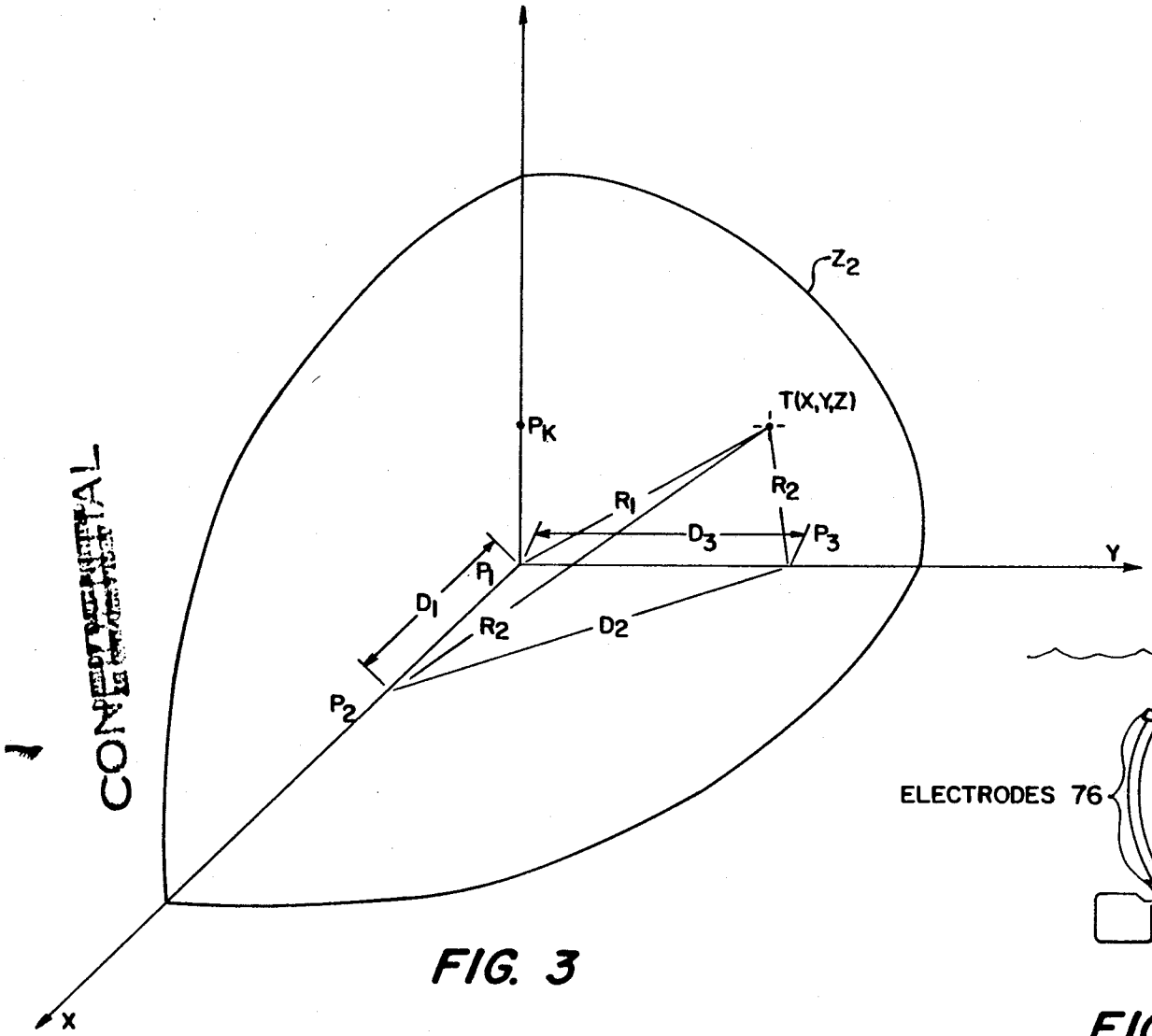
FIG. 3 is a repetition of the geometric diagram of FIG. 1 reduced in scale in order to show the threshold condition.

There are several sources of possible error in determining the true position and tracking the course of a weapon with respect to its launching vessel. The embodiment shown in FIG. 2 provides a second safety system, available if the weapon penetrates a second or neutralization zone encompassed by the activation zone (e.g., the turnaway safety system fails, or, the turnaway system performs but the weapon quickly resumes a course approximately homing on the launching vessel, thus indicating that the weapon must pass close by the launching vessel in order to reach the target). Upon making a determination that the weapon is within the activation zone $Z_2$, (shown in the three dimensional Cartesian graph of FIG. 3) and maintaining a course approximately homing on the launching vessel, computer 70 causes electromagnetic generator 74 to create a magnetic field substantially corresponding to the neutralization zone via a plurality of electrodes 76 mounted on the launching vessel 100, as shown by the illustration of FIG. 4. As it enters the neutralization zone, electrodes 76 mounted on the weapon sense the magnetic field and cause the weapon detonator to be neutralized. Once clear of the neutralization zone, the weapon's detonator is again activated.

It will be apparent that the invention in the above described system discloses a method and apparatus enabling a vehicle to launch a weapon against a target at close quarters without unduly exposing itself to the risk of attack by a weapon that subsequently acquires and homes on the launching vehicle. By tracking its weapon, and utilizing the turnaway and dudding systems in accordance with the teachings of the present invention, a vehicle is enabled to launch a weapon capable of searching for and acquiring a target while still within the immediate vacinity of the launching vehicle. In addition, the dudding system provides safety for the launching vessel while a returning missile passes through the immediate vacinity of the vessel without interrupting the search and acquisition activities of the missile.

The foregoing embodiment is merely illustrative of the basic principles of the invention. Obviously, numerous modifications, variations and applications of the present invention are possible in the light of the above teachings. For example, although the weapon tracking system is described as having three tracking channels, it is possible for embodiments of the invention to have more than three channels, each channel having a hydrophone k individually connectable in series with one channel of a receiver 30, a logic device m and a timer n. In an embodiment having more than three channels, upon receipt and detection of a fourth return acoustic signal, respectively by hydrophone k and the corresponding channel of receiver 30, logic device m will be switched to its ON state thereby stopping timer n. Input selector 60, sensing that the timer n has ceased generation of periodic pulses, transmits a fourth pulse to time-register 62 and then covers data indicative of the time and identity of timer n to computer 70. Upon receipt of this data, computer 70 determines the value of the corresponding distance $R_x$ according to formula (1) and then redundantly calculates and selectively compares the coordinates of the missile transponder.

While hydrophones 11, 12, 13 . . . k are selected for detection of a narrow range of acoustic frequencies in a seawater environment, in another embodiment, they might be replaced by another type of antenna or selected for detection of an above sonic range of frequencies. Although FIG. 2 shows clocks 64 and 72, a simplified embodiment constructed according to the invention could use a single clock for providing the time to both time register 62 and computer 70.

For the purpose of disclosing the present invention, the apparatus and method were described by reference to an embodiment used in a vessel for deterring a weapon from acquiring and attacking its launching vessel. It will be obvious to those skilled in the art that these teachings are equally applicable to a safety system for deterring a missile from detrimentally returning to any launching device, whether a mobile launching vehicle such as an aircraft, a land vehicle, a ship, a submersible, or a stationary launching assembly.

It is therefore to be understood that within the scope of the appended claims, the invention may be practiced otherwise than as specifically described.

What is claimed as new and desired to be secured by Letters Patent of the United States is:

1. In a tracking system having a transmitter capable of transmitting a range signal in response to reception of a start pulse and a turnaway signal in response to reception of an alarm pulse, an antenna for propagating the range and turnaway signals, at least three non-colinearly spaced antennae in conjunction with the propagating antenna for receiving replies to said range signal, a receiver having a plurality of output channels, and coupling means for selectively connecting said transmitter to the antenna and said receiver to the antennae, the combination comprising:

computer means having a first output terminal connected to said transmitter, a second output terminal connected to said receiver and a first and a second input terminal, and having an algorithm for determining the coordinates of each of said replies in respect to said antennae, for transmitting an alarm pulse and periodically transmitting a start pulse via the first output terminal, receiving time signals via the first input terminal, receiving a plurality of reply data via said second input terminal, correlating the clock signals with the reply data, determining the coordinates of each of said replies according to the algorithm in dependence upon the clock signals and the reply data, and transmitting a clear signal via the second output terminal;

a clock connected to said first input terminal for providing said time signals;

a plurality of logic devices equal in number to and separately coupled in series with the output channels of said receiver, each for providing a ONE logic pulse upon reception of one of said replies via one of the output channels of said receiver and providing a ZERO logic signal upon reception of said clear signal;

a plurality of parallel timer circuits equal in number to and each having a first inlet terminal separately coupled in series with the corresponding of said logic devices and a second inlet terminal coupled in parallel with said first output terminal, and an outlet terminal, each timer circuit generating periodic pulses commencing upon reception of said start signal and ceasing upon reception of respective said ONE logic pulse;

a time register connected to and receiving time signals from said clock for providing a clock signal in response to reception of a selector pulse; and, an input selector having one terminal connected to said second input terminal, a pair of terminals connected in duplex with said time register, and a plurality of terminals separately connected in series with said outlet terminals, for providing a selector pulse to said time register as each timer circuit ceases generation of periodic pulses and conveying reply data to said computer indicative of the corresponding clock signal and the identity of the respective timer circuit;

whereby said computer means determines the coordinates of each of said replies and transmits to said transmitter an alarm pulse if successive sets of said coordinates fail to satisfy a predetermined condition.

2. A tracking system as set forth in claim 1 further comprising a transponder located at a varying distance from said antennae for receiving and transmitting a reply to said first signal.

3. A tracking system as set forth in claim 1, whereby:

said computer means transmits a dudding signal if any of said sets of coordinates fails to satisfy a threshold condition;

further comprising:

an electromagnetic generator for providing electric energy in response to a dudding signal from said computer; and, a plurality of electrodes electrically connected to said electromagnetic generator and arranged to create a magnetic field.

4. A safety system to protect a vessel from a warhead-bearing, mobile missile with guidance controlled in dependence upon a search for a vagariously moveable target, comprising:

tracking means for successively determing position and course of the missile with respect to the vessel;

an acoustic turnaway system to influence the guidance upon determination that the course will intercept the vessel; and, an electromagnetic dudding system to deactivate the warhead upon determination that the position is within a selected distance of the vessel.

5. The safety system set forth in claim 4, further comprised of:

the vessel being a submarine; and, the missile being a torpedo.

6. The safety system set forth in claim 4, further comprised of:

the vessel being a launcher of the missile.

7. In a system for tracking a transponder borne by a missile following a course determined by an influenceable guidance system seeking a vagariously moving target and bearing an electromagnetically interruptable detonator, the improvement comprising:

a transmitter capable of generating a range signal in response to reception of a start pulse and a turnaway signal sufficient to influence said guidance system upon reception of an alarm pulse;

an antenna for propagating the range and turnaway signals, at least three non-colinearly spaced antennae in conjunction with said antenna, for receiving replies issued by said transponder to said range signal;

a receiver having a plurality of output channels;

coupling means for selectively connecting said transmitter to the antenna and said receiver to the antennae, and coupling each of said antennae to ground upon reception of a clear signal;

computer means having a first output terminal connected to said transmitter, a second output terminal connected to said receiver, a third output terminal and a first and a second input terminal, and an algorithm to determine the coordinates in respect to each said antennae of said transponder for each reply issued to said range signal, for periodically transmitting a start pulse via the first output terminal, receiving time signals via the first input terminal, receiving a plurality of reply data via said second input terminal, correlating the clock signals with the reply data, determining the coordinates of each reply according to the algorithm in dependence upon the clock signals and the reply data, transmitting a clear signal via the second output terminal;

a clock connected to said first input terminal for providing said time signals;

a plurality of logic devices equal in number to and separately coupled in series with the output channels of said receiver, for providing a ONE logic pulse upon reception of one of said replies via one of the output channels of said receiver and providing a ZERO logic signal upon reception of said clear signal;

a plurality of parallel timer circuits equal in number to and each having a first inlet terminal separately coupled in series with a corresponding said logic device and a second inlet terminal coupled in parallel with said first output terminal, and an outlet terminal, each timer circuit generating periodic pulses commencing upon reception of said start signal and ceasing upon reception of a ONE logic pulse;

a time register connected to and receiving time signals from said clock for providing a clock signal in response to reception of a selector pulse; and, an input selector having one terminal connected to said second input terminal, a pair of terminals connected in duplex with said time register, and a plurality of terminals separately connected in series with said outlet terminals, for providing a selector pulse to said time register as each timer circuit ceases generation of periodic pulses and conveying reply data to said computer indicative of the corresponding clock signal and the identity of the respective timer circuit;

whereby said computer means transmits to said transmitter an alarm pulse if successive sets of said coordinates fail to satisfy a predetermined condition, and a dudding pulse via said third output terminal if any of said coordinates fail to satisfy a threshold condition.

8. A system as set forth in claim 7 further comprising:

an electromagnetic generator for providing electric energy upon reception of a dudding pulse via said third output terminal; and, a plurality of electrodes electrically connected to said electromagnetic generator and arranged to create a magnetic field.

* * * * *